US009147372B2

(12) United States Patent
Nakata et al.

(10) Patent No.: US 9,147,372 B2
(45) Date of Patent: Sep. 29, 2015

(54) DISPLAY DEVICE

(75) Inventors: Jun Nakata, Osaka (JP); Masami Ozaki, Osaka (JP); Kohji Saitoh, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 108 days.

(21) Appl. No.: 14/006,066

(22) PCT Filed: Mar. 26, 2012

(86) PCT No.: PCT/JP2012/057712

§ 371 (c)(1),
(2), (4) Date: Sep. 18, 2013

(87) PCT Pub. No.: WO2012/133281

PCT Pub. Date: Oct. 4, 2012

(65) Prior Publication Data

US 2014/0009459 A1 Jan. 9, 2014

(30) Foreign Application Priority Data

Mar. 31, 2011 (JP) ..... 2011-081171

(51) Int. Cl.
*G09G 3/36* (2006.01)

(52) U.S. Cl.
CPC ..... *G09G 3/3696* (2013.01); *G09G 3/3688* (2013.01); *G09G 3/3614* (2013.01); *G09G 2310/0291* (2013.01); *G09G 2330/021* (2013.01)

(58) Field of Classification Search
CPC . G09G 3/3611; G09G 3/3614; G09G 3/3648; G09G 3/3685; G09G 3/3688; G09G 3/3692; G09G 2310/0297; G09G 3/3696; G09G 2310/0291; G09G 2330/021
USPC ..... 345/96, 98, 99, 100, 204, 208, 209
See application file for complete search history.

(56) References Cited

U.S. PATENT DOCUMENTS

| | | | | |
|---|---|---|---|---|
| 7,903,072 | B2 * | 3/2011 | Yamazaki | 345/98 |
| 8,228,276 | B2 * | 7/2012 | Lee et al. | 345/89 |
| 8,471,842 | B2 * | 6/2013 | Ha | 345/215 |
| 8,624,817 | B2 * | 1/2014 | Kim et al. | 345/99 |
| 2001/0052888 | A1 * | 12/2001 | Hebiguchi | 345/87 |
| 2003/0146909 | A1 | 8/2003 | Maki | |
| 2004/0056852 | A1 * | 3/2004 | Shih et al. | 345/204 |
| 2005/0156862 | A1 * | 7/2005 | Hirayama et al. | 345/100 |
| 2005/0281127 | A1 * | 12/2005 | Okuno et al. | 365/233 |

(Continued)

FOREIGN PATENT DOCUMENTS

| | | | |
|---|---|---|---|
| JP | 2003-208132 | A | 7/2003 |
| JP | 2007-140256 | A | 6/2007 |
| JP | 2007-272203 | A | 10/2007 |

*Primary Examiner* — Tom Sheng
(74) *Attorney, Agent, or Firm* — Chen Yoshimura LLP

(57) ABSTRACT

The purpose of the present invention is to provide a display device that has a simple configuration and small power consumption. A display device of the present invention has: source output amplifiers (36) fewer in number than a plurality of source signal lines (S); and a switching unit (32) that supplies data signals outputted from each of the source output amplifiers (36) to one of the source signal lines (S). Each of the source output amplifiers (36) outputs the data signals having different polarities to the source signal lines (S) adjacent to each other, and outputs the data signals by switching, by each frame period, the polarities of the data signals to be supplied to the source signal lines (S).

4 Claims, 14 Drawing Sheets

(56) References Cited

U.S. PATENT DOCUMENTS

| | | | | |
|---|---|---|---|---|
| 2006/0221701 | A1* | 10/2006 | Sun | 365/185.22 |
| 2007/0046606 | A1* | 3/2007 | Kim et al. | 345/90 |
| 2007/0205976 | A1 | 9/2007 | Takatori et al. | |
| 2007/0279093 | A1* | 12/2007 | Senda et al. | 326/81 |
| 2008/0043012 | A1* | 2/2008 | Shirai | 345/215 |
| 2008/0180369 | A1* | 7/2008 | Chiu et al. | 345/87 |
| 2008/0252588 | A1* | 10/2008 | Huang | 345/100 |
| 2009/0002359 | A1* | 1/2009 | Tamura | 345/213 |
| 2009/0015574 | A1* | 1/2009 | Kim et al. | 345/208 |
| 2009/0273388 | A1* | 11/2009 | Yamashita | 327/416 |
| 2010/0013864 | A1* | 1/2010 | Oelhafen et al. | 345/690 |
| 2011/0090416 | A1* | 4/2011 | Arasawa et al. | 349/38 |
| 2013/0241959 | A1* | 9/2013 | Ge et al. | 345/690 |

* cited by examiner

DISPLAY DEVICE

TECHNICAL FIELD

The present invention relates to a display device.

BACKGROUND ART

Recently, display devices with thin-profile, light-weight, and low power consumption such as liquid crystal display devices are widely used. Such display devices are mainly used for mobile phones, smartphones, PDAs (personal digital assistants), electronic books, laptop personal computers, and the like, for example. Also, electronic paper, which is an even thinner display device, is expected to be developed and put in practical use rapidly in the coming years.

An active matrix mode is used in many such display devices. In general, the display screen of an active matrix display device is constituted of a plurality of pixels disposed in a grid pattern. Corresponding to these pixels, the display device includes a plurality of gate signal lines for sequential selection of a plurality of rows of pixels, and a plurality of source signal lines for supplying a source signal to the respective pixels of the selected row of pixels. By having an analog amp (hereinafter referred to as a "source output amplifier") included in a source driver supply a data signal (hereinafter referred to as a "source signal") as image data to the respective plurality of source signal lines, source signals are written to the respective pixels of a selected row of pixels.

Thus, as disclosed in Patent Document 1 below, for example, in a conventional display device, a plurality of source output amplifiers are provided in the source driver for respective source signal lines. A configuration is used such that when supplying source signals to the respective plurality of source signal lines, every time the source signal line to be supplied a source signal is switched, the source output amplifier to be used is switched to the source output amplifier that is paired with the source signal line. If the resolution of the display device is 1366×768, for example, then the source driver includes 1366 source output amplifiers.

RELATED ART DOCUMENT

Patent Document

Patent Document 1: Japanese Patent Application Laid-Open Publication, "Japanese Patent Application Laid-Open Publication No. 2007-140256"

SUMMARY OF THE INVENTION

Problems to be Solved by the Invention

In recent years, display devices have become higher definition and higher resolution, and as a result, there has been demand for displaying images more efficiently by simplifying the configuration, reducing power consumption, and the like in such a display device. However, with the technique disclosed in Patent Document 1, a large number of source output amplifiers are included, which makes the configuration more complex, increases power consumption, and the like, which means that it is not possible to display images more efficiently.

The present invention takes into consideration the aforementioned problems, and an object thereof is to provide a display device that can display images more efficiently.

Means for Solving the Problems

In order to solve the above-mentioned problems, a display device according to the present invention includes: a display panel having a plurality of gate signal lines and a plurality of source signal lines; a gate driver that sequentially selects the plurality of gate signal lines and performs scanning thereon; and a source driver that supplies data signals through the plurality of source signal lines to a plurality of pixels, respectively connected to a selected gate signal line, wherein the source driver includes: source output amplifiers that are fewer in number than the plurality of source signal lines; and a switching unit that switches a destination of a data signal to a source signal line among the plurality of source signal lines, every time the source output amplifiers output the data signal, wherein, with respect to each of the source output amplifiers, by using the switching unit in order to switch a destination of a first type data signal having a positive potential and a second type data signal having a negative potential, which are sequentially outputted from the source output amplifiers, the first type data signal and the second type data signal are supplied in an alternating fashion to the respective plurality of pixels connected to each of the plurality of gate signal lines, and only one of either the first type data signal or the second type data signal is supplied to the plurality of pixels connected to each of the plurality of source signal lines, and wherein, every time a frame period is switched, a data signal supplied to the plurality of pixels is switched between the first type data signal and the second type data signal for each of the plurality of source signal lines.

According to this configuration, it is possible to reduce the number of source output amplifiers compared to a configuration of a conventional display device in which a source output amplifier is provided for each source signal line, and thus, the cost associated with the source driver can be reduced. Also, by reducing the number of source output amplifiers, it is possible to reduce the total steady current needed by the source output amplifiers. Thus, it is possible to reduce power consumption. In other words, it is possible to display images more efficiently.

Effects of the Invention

According to the display device of the present invention, it is possible to display images more efficiently.

DETAILED DESCRIPTION OF EMBODIMENTS

Embodiments of the present invention will be explained below with reference to drawings.

Embodiment 1

Figure 1:
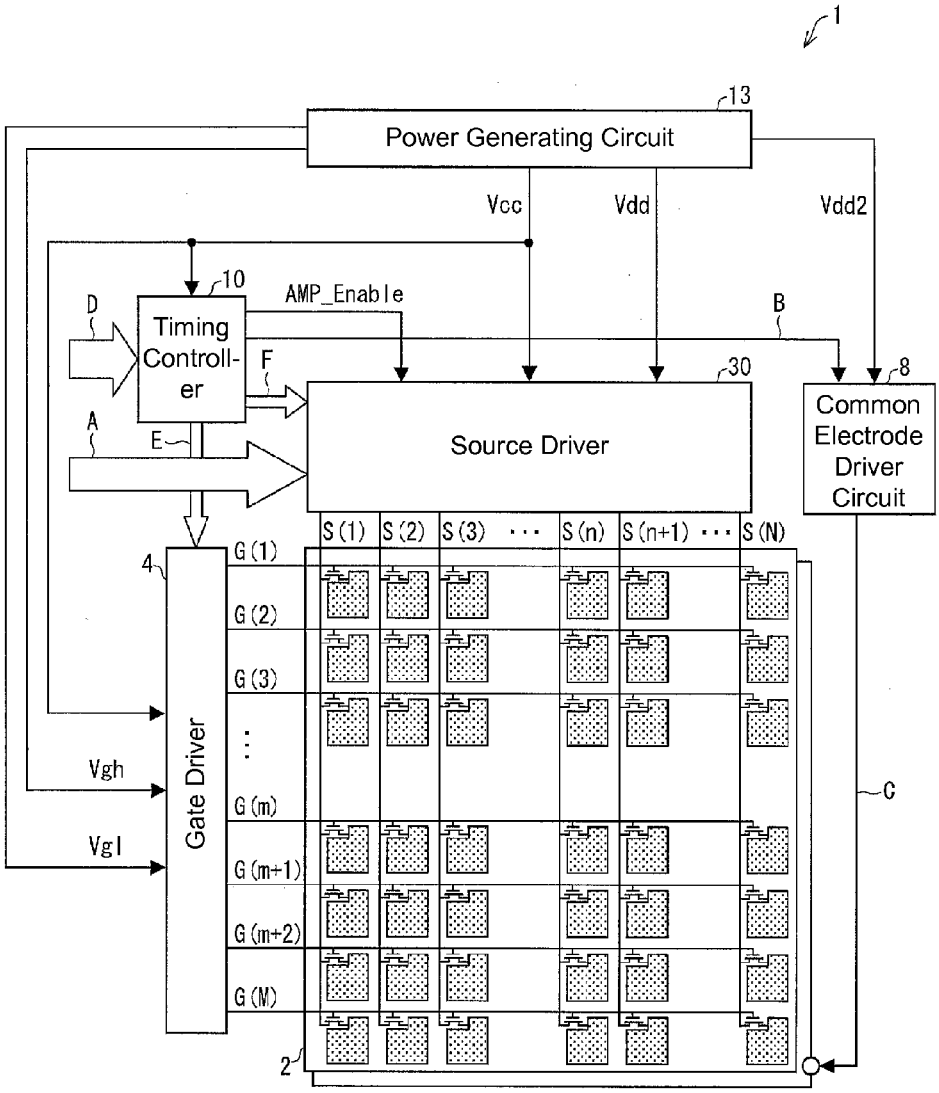
FIG. 1 is a diagram showing an overall configuration of a display device of Embodiment 1.

First, Embodiment 1 of the present invention will be explained. A configuration of a display device 1 of Embodiment 1 will be explained with reference to FIG. 1. FIG. 1 is a diagram showing an overall configuration of the display device 1 of Embodiment 1. As shown in this drawing, the display device 1 includes a display panel 2, a gate driver (scanning line driver circuit) 4, a source driver (signal line driver circuit) 30, a common electrode driver circuit 8, a timing controller 10, and a power generating circuit 13.

In Embodiment 1, an active matrix liquid crystal display device is used as the display device 1. Thus, the display panel 2 of Embodiment 1 is an active matrix liquid crystal display panel, and the other components described above are for driving the liquid crystal display panel.

The display panel 2 includes a display screen constituted of a plurality of pixels arranged in a grid pattern, an "M" number of gate signal lines (scan signal lines) G for selectively scanning the lines of the display screen sequentially, and an "N" number of source signal lines (data signal lines) S for supplying a data signal to each pixel included in a row of a selected gate signal line. The gate signal lines G and the source signal lines S intersect each other perpendicularly.

In the description below the gate signal line G connected to the mth row pixels (m being any integer) is indicated as G(m). If G(m) is the gate signal line G connected to the tenth row of pixels, for example, then G(m+1), G(m+2), and G(m+3) are gate signal lines G connected to pixels in the eleventh row, twelfth row, and thirteenth row, respectively.

In the description below, the source signal line S connected to pixels in the nth column (n being any integer) is indicated as S(n). If S(n) is the source signal line S connected to the tenth column of pixels, for example, then S(n+1), S(n+2), S(n+3), S(n+4), and S(n+5) are source signal lines S connected to pixels in the eleventh column, twelfth column, thirteenth column, fourteenth column, and fifteenth column, respectively.

The gate driver 4 sequentially scans the respective gate signal lines G from the top to bottom of the display screen. The gate driver 4 sequentially outputs to the respective gate signal lines G a voltage for turning on a switching element (TFT) provided for each pixel on the gate signal line G. As a result, the gate driver 4 sequentially selects the respective gate signal lines G and performs scanning.

The source driver 30 supplies source signals to the respective pixels on the selected gate signal line G through the source signal lines S. Specifically, the source driver 30 calculates the value of the voltage to be outputted to each pixel on the selected gate signal line G based on an inputted image signal (the arrow A), and a voltage of that value is outputted from source output amplifiers to each source signal line S. As a result, source signals are supplied to the respective pixels on the selected gate signal line G, thus writing a source signal.

The display device 1 includes a common electrode (not shown) disposed to face the respective pixels on the display screen. The common electrode driver circuit 8 outputs to the common electrode a prescribed common voltage for driving the common electrode, based on a signal (the arrow B) sent from the timing controller 10.

The timing controller 10 outputs a signal to the respective circuits, the signal being a reference for the respective circuits to operate in synchronization. Specifically, the timing controller 10 supplies a gate start pulse signal, a gate clock signal GCK, and a gate output control signal GOE (arrow E) to the gate driver 4. The timing controller 10 outputs a source start pulse signal, a source latch strobe signal, and a source clock signal (arrow F) to the source driver 30.

The gate driver 4 starts scanning of the display panel 2 upon receipt of the gate start pulse signal from the timing controller 10, and sequentially applies selection voltage to the respective gate signal lines G in accordance with the gate clock signal GCK and the gate output control signal GOE received from the timing controller 10. Specifically, the gate driver 4 sequentially selects the respective gate signal lines G in accordance with the received gate clock signal GCK. The gate driver 4 applies a selection voltage to a selected gate signal line G when it detects that the received gate output control signal GOE has ended. As a result, the gate driver 4 performs scanning on the selected gate signal line G.

Upon receipt of the source start pulse signal from the timing controller 10, the source driver 30 stores the received image data of each pixel in a register according to the source clock signal, and writes the image data into the respective source signal lines S in the display panel 2 according to the subsequent source latch strobe signal.

The power generating circuit 13 generates voltages Vdd, Vdd2, Vcc, Vgh, and Vgl that are necessary to operate the respective circuits in the display device 1. Then, Vcc, Vgh, and Vgl are outputted to the gate driver 4, Vdd and Vcc are outputted to the source driver 30, Vcc is outputted to the timing controller 10, and Vdd2 is outputted to the common electrode driver circuit 8.

(Writing Operation)

For each of the plurality of gate signal lines G, when focusing on the plurality of pixels on the gate signal line G, the source driver 30 causes the polarity of the voltage (from the reference voltage) supplied as the source signal to be inverted for every source signal line S (every pixel) and supplies the source signal to the respective source signal lines S.

On the other hand, for each of the plurality of source signal lines S, with respect to the plurality of pixels on the source signal line S, the source driver 30 supplies a source signal to each source signal line S without inverting the polarity of the voltage (from the reference voltage) supplied as the source signal.

Thus, on the display panel 2, in the same frame period, source signal lines S to which only a source signal with a positive source signal potential (first type data signal; hereinafter referred to as "source signal (+)") is supplied alternates with source signal lines S to which only a source signal with a negative source signal potential (second type data signal; hereinafter referred to as "source signal (−)") is supplied.

As shown in FIGS. 2 to 12, in each row of pixels, pixels to which the source signal (+) is written and pixels to which the source signal (−) is written are disposed alternately, and in each column of pixels, either pixels to which the source signal (+) is written or pixels to which the source signal (−) is written are present.

Every time the frame period switches, for each of the plurality of source signal lines S, the data signal supplied to the plurality of pixels on the source signal line switches between the source signal (+) and the source signal (−).

Such a method for display driving described above is referred to as "frame inversion driving."

(Configuration Example of Source Driver 30)

Figure 2:
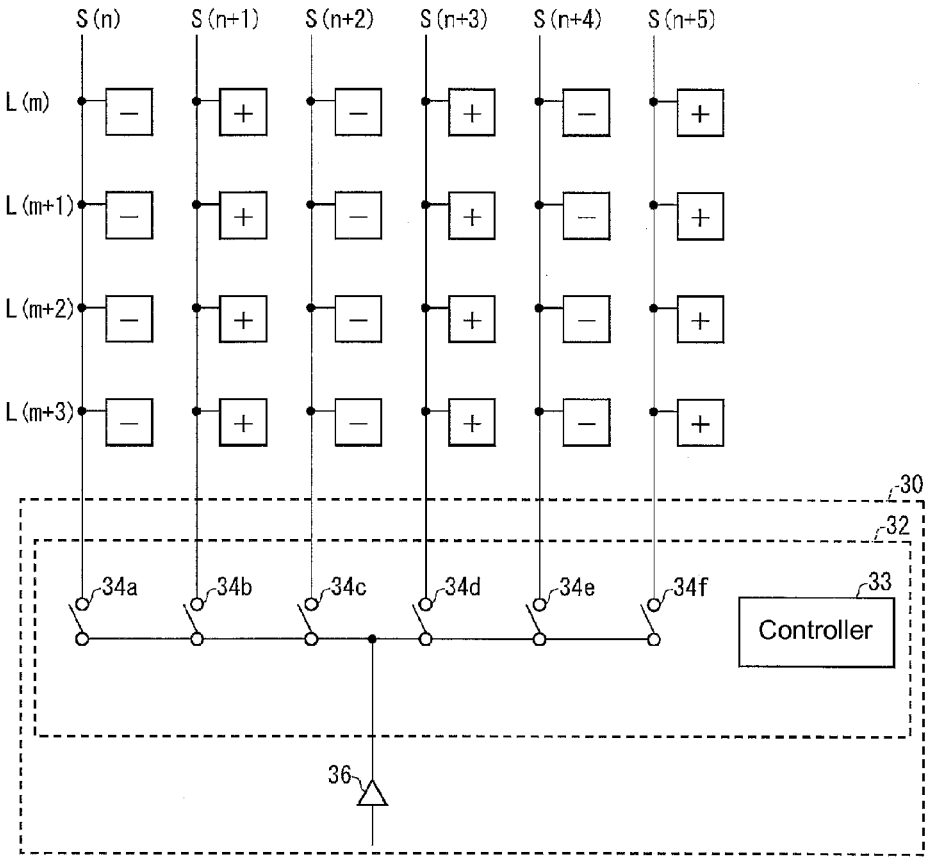
FIG. 2 is a diagram showing an example of a configuration of a source driver of Embodiment 1.

Here, a configuration example of the source driver 30 will be described. FIG. 2 shows a configuration example of the source driver 30 according to Embodiment 1. For ease of description, the configuration example of the source driver 30 will be described using the source signal lines S(n) to S(n+5) among the plurality of source signal lines included in the display panel 2, and the rows of pixels L(m) to L(m+3) among the plurality of rows of pixels. Other components such as a DA converter generally included in the source driver 30 are not shown in drawings, and descriptions thereof will be omitted.

FIG. 2 and drawings thereafter show a state in a certain frame period, and in FIG. 2 and the drawings thereafter, pixels labeled with "+" indicate pixels to which the source signal (+) is written during this frame period. Pixels labeled with "−" indicate pixels to which the source signal (−) is written during this frame period.

In the present embodiment, frame inversion driving, or in other words, a configuration in which the source signal to be written to each pixel has its polarity inverted every frame period, is used. Thus, a first frame period and a second frame period alternate, the first frame period being a period during which operations described with reference to FIG. 2 and drawings thereafter are conducted, the second frame period being a period during which the source signal to be written to each pixel has its polarity inverted from what it was in the first frame period.

As shown in FIG. 2, the source driver 30 of Embodiment 1 includes a source output amplifier 36 that is fewer in number than the source signal lines S unlike a conventional display device in which the same number of source output amplifiers as the source signal lines S are included. Specifically, the source driver 30 of Embodiment 1 has one source output amplifier 36.

In other words, the source driver 30 of Embodiment 1 supplies source signals to the plurality of source signal lines S using the one source output amplifier 36.

In order to achieve this, the output side of the source output amplifier 36 has a switching unit 32 for switching the source signal line S to which the source signal outputted from the source output amplifier 36 is supplied.

In the example shown in FIG. 2, the switching unit 32 includes a plurality of switches 34*a* to 34*f* for respective source signal lines S. One end of each of the switches 34 is connected to the corresponding source signal line S. The other end of each of the switches 34 is connected to the output end of the source output amplifier 36. The operation of the respective switches 34 (in other words, whether they are on or off) is controlled by a controller 33 included in the switching unit 32.

(Writing Operation by Source Driver 30)

When a source signal is to be supplied to a certain source signal line S, the controller 33 turns on a switch 34 corresponding to this source signal line S. At this time, other switches 34 remain off. As a result, the source output amplifier 36 and the source signal line S are electrically connected, and the source signal outputted from the source output amplifier 36 is supplied to the corresponding source signal line S.

The controller 33 switches which switch is turned on depending on which source signal line S the source signal is to be supplied to, every time a source signal is outputted from the source output amplifier 36. Thus, a source signal is supplied to each of the plurality of source signal lines S.

One horizontal period in the display device 1 of Embodiment 1 includes a first writing period, a second writing period, a third writing period, a fourth writing period, a fifth writing period, and a sixth writing period, in this order, for example. The first to sixth writing periods are writing periods corresponding to the respective source signal lines S(n) to S(n+5).

The controller 33 turns on a corresponding switch 34 every time the writing period changes, and turns off all other switches 34. As a result, during each writing period, a corresponding source signal line S is connected to the source output amplifier 36, and a source signal outputted from the source signal amp 36 is supplied to this source signal line S.

With reference to FIGS. 3 to 8, a specific example of a writing operation of a source signal by the source driver 30 of Embodiment 1 will be described below.

(First Writing Period)

Figure 3:
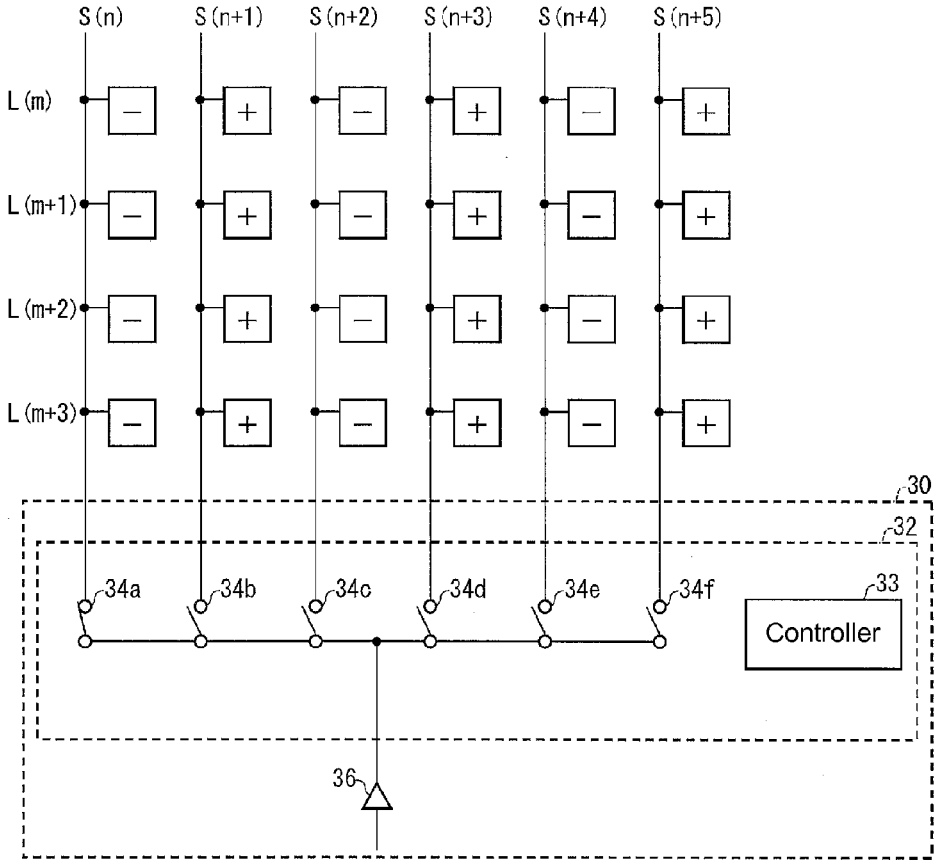
FIG. 3 shows a first writing period state of the source driver of Embodiment 1.

FIG. 3 shows a first writing period state of the source driver 30 of Embodiment 1. During the first writing period, the source driver 30 writes a source signal to the source signal line S(n). Thus, as shown in FIG. 3, the controller 33 turns on the switch 34*a* corresponding to the source signal line S(n) and turns off all other switches. As a result, the source output amplifier 36 and the source signal line S(n) are electrically connected to each other, and the source signal outputted from the source output amplifier 36 is supplied to the source signal line S(n).

(Second Writing Period)

Figure 4:
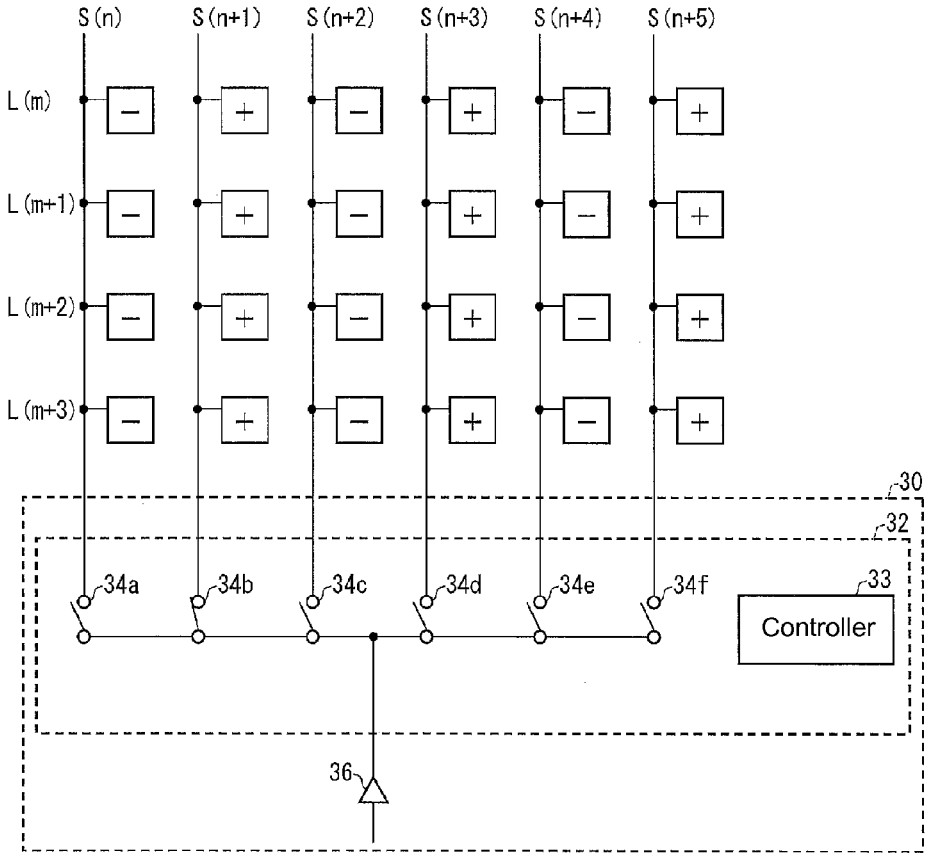
FIG. 4 shows a second writing period state of the source driver of Embodiment 1.

FIG. 4 shows a second writing period state of the source driver 30 of Embodiment 1. During the second writing period, the source driver 30 writes a source signal to the source signal line S(n+1). Thus, as shown in FIG. 4, the controller 33 turns on the switch 34*b* corresponding to the source signal line S(n+1) and turns off all other switches. As a result, the source output amplifier 36 and the source signal line S(n+1) are electrically connected to each other, and the source signal outputted from the source output amplifier 36 is supplied to the source signal line S(n+1).

(Third Writing Period)

Figure 5:
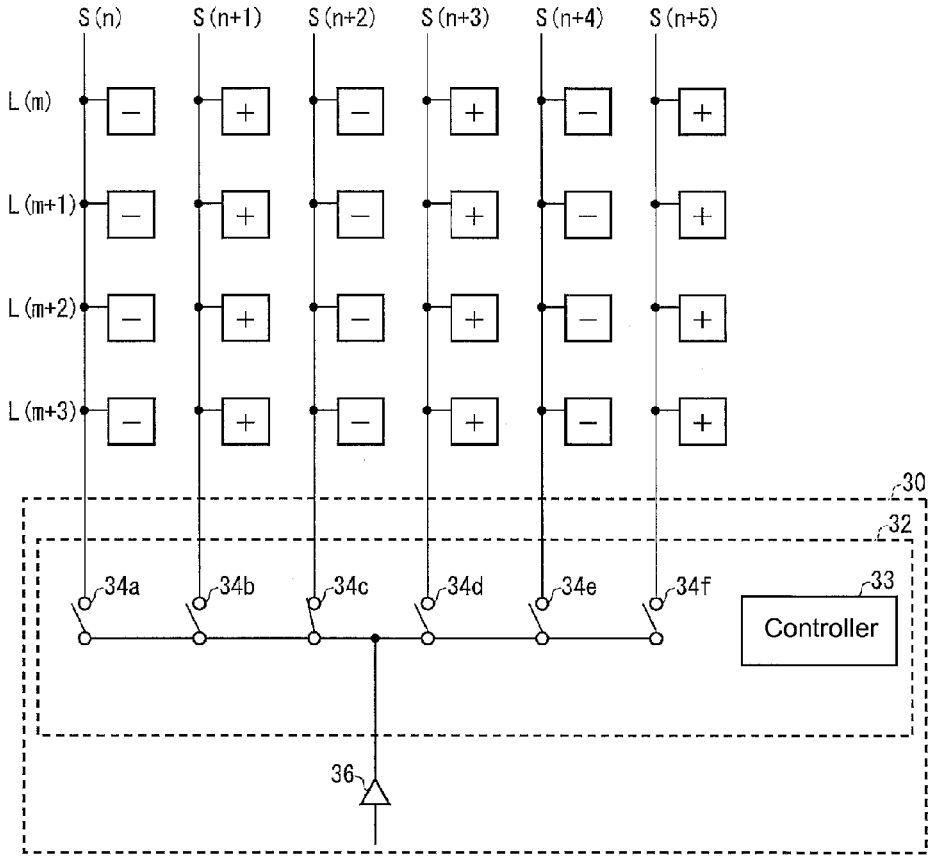
FIG. 5 shows a third writing period state of the source driver of Embodiment 1.

FIG. 5 shows a third writing period state of the source driver 30 of Embodiment 1. During the third writing period, the source driver 30 writes a source signal to the source signal line S(n+2). Thus, as shown in FIG. 5, the controller 33 turns on the switch 34*c* corresponding to the source signal line S(n+2) and turns off all other switches. As a result, the source output amplifier 36 and the source signal line S(n+2) are electrically connected to each other, and the source signal outputted from the source output amplifier 36 is supplied to the source signal line S(n+2).

(Fourth Writing Period)

Figure 6:
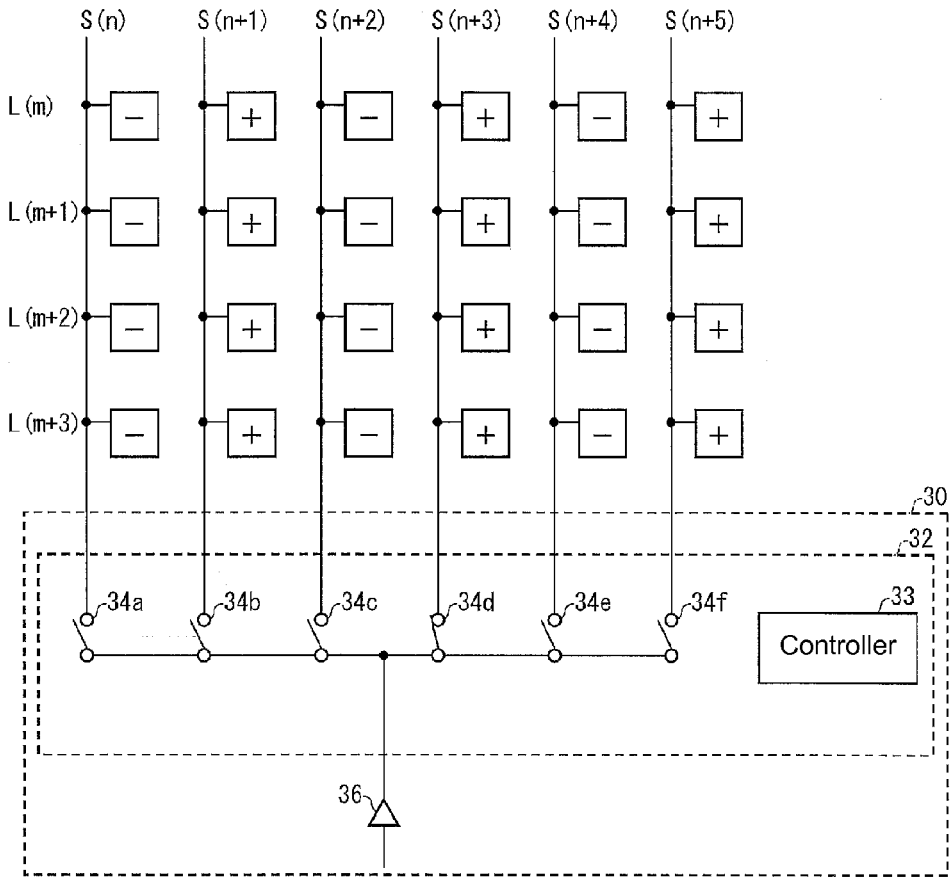
FIG. 6 shows a fourth writing period state of the source driver of Embodiment 1.

FIG. 6 shows a fourth writing period state of the source driver 30 of Embodiment 1. During the fourth writing period, the source driver 30 writes a source signal to the source signal line S(n+3). Thus, as shown in FIG. 6, the controller 33 of the switching unit 32 turns on the switch 34*d* corresponding to the source signal line S(n+3) and turns off all other switches. As a result, the source output amplifier 36 and the source signal line S(n+3) are electrically connected to each other, and the source signal outputted from the source output amplifier 36 is supplied to the source signal line S(n+3).

(Fifth Writing Period)

Figure 7:
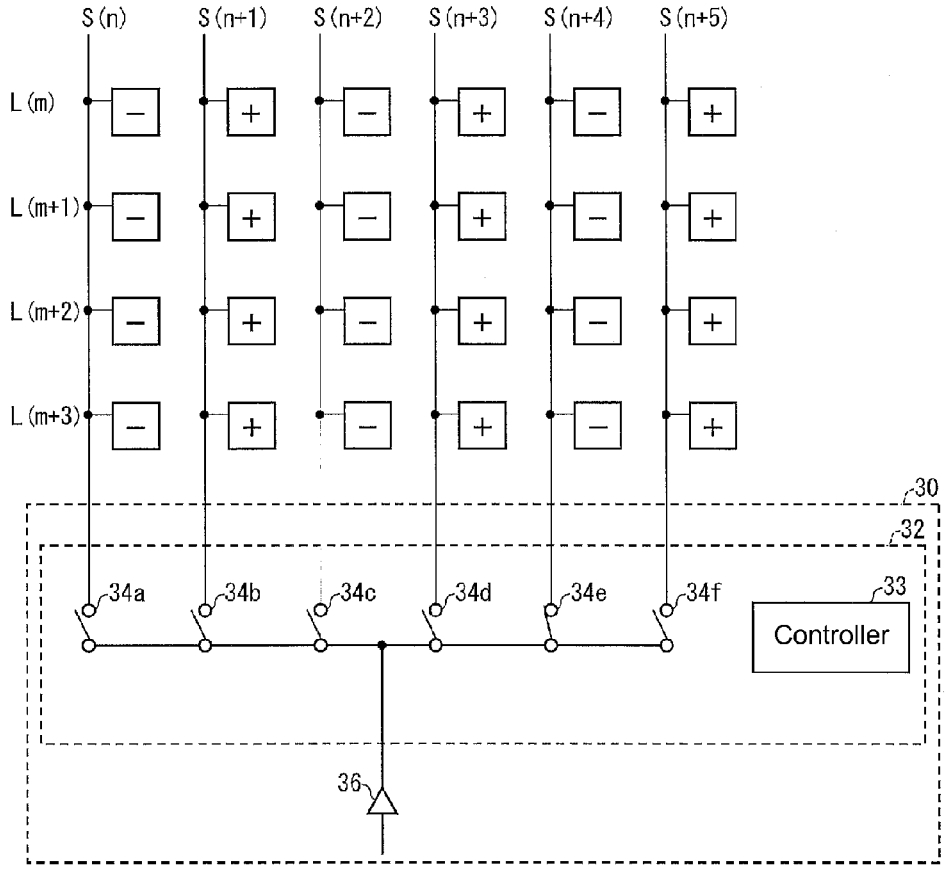
FIG. 7 shows a fifth writing period state of the source driver of Embodiment 1.

FIG. 7 shows a fifth writing period state of the source driver 30 of Embodiment 1. During the fifth writing period, the source driver 30 writes a source signal to the source signal line S(n+4). Thus, as shown in FIG. 7, the controller 33 of the switching unit 32 turns on the switch 34*e* corresponding to the source signal line S(n+4) and turns off all other switches. As a result, the source output amplifier 36 and the source signal line S(n+4) are electrically connected to each other, and the source signal outputted from the source output amplifier 36 is supplied to the source signal line S(n+4).

(Sixth Writing Period)

Figure 8:
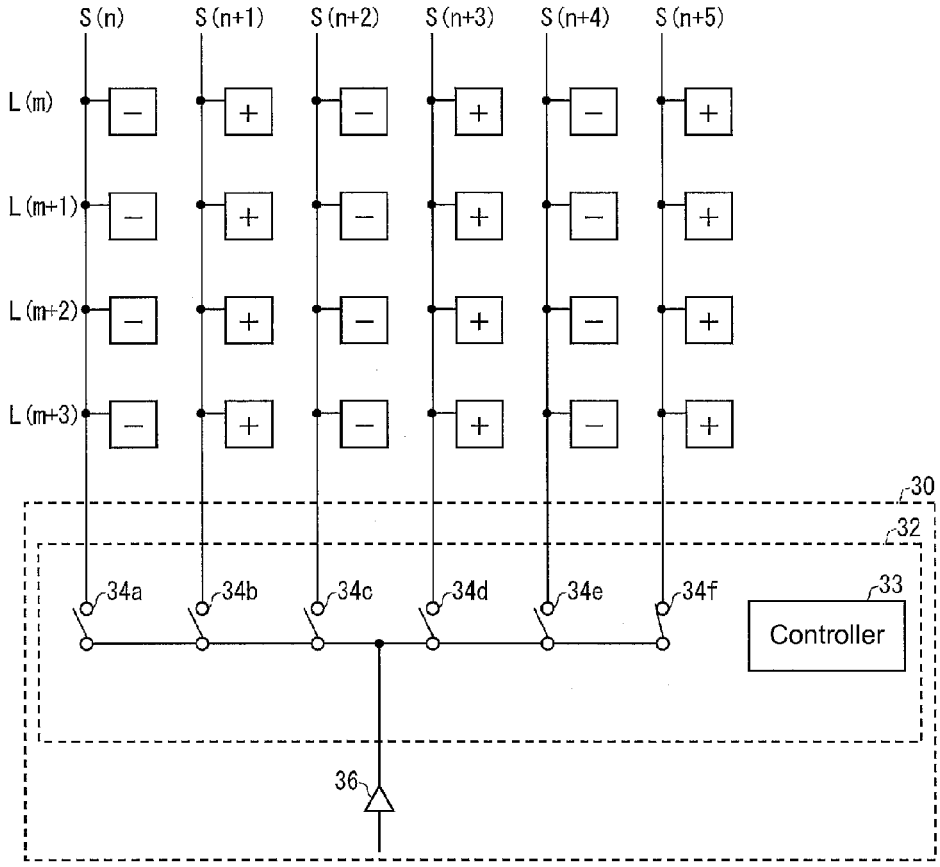
FIG. 8 shows a sixth writing period state of the source driver of Embodiment 1.

FIG. 8 shows a sixth writing period state of the source driver 30 of Embodiment 1. During the sixth writing period, the source driver 30 writes a source signal to the source signal line S(n+5). Thus, as shown in FIG. 8, the controller 33 of the switching unit 32 turns on the switch 34*f* corresponding to the source signal line S(n+5) and turns off all other switches. As a result, the source output amplifier 36 and the source signal line S(n+5) are electrically connected to each other, and the source signal outputted from the source output amplifier 36 is supplied to the source signal line S(n+5).

(Switching of Polarity of Source Signal)

As already described, the source driver 30 of Embodiment 1 conducts frame inversion driving. Thus, the source output amplifier 36 switches the polarity of the source signal potential of the source signal to be supplied every time the source signal line S to which the source signal is to be supplied is switched (in other words, when the writing period is switched) during the first to sixth writing periods.

For example, during the first, third, and fifth writing periods, the source output amplifier 36 outputs the source signal (−) with a negative source signal potential to the respective rows of pixels shown in FIGS. 2 to 8. Thus, the source signal (−) is supplied to the respective source signal lines S(n), S(n+2), and S(n+4).

On the other hand, during the second, fourth, and sixth writing periods, the source output amplifier 36 outputs the source signal (+) with a positive source signal potential. Thus, the source signal (+) is supplied to the respective source signal lines S(n+1), S(n+3), and S(n+5).

As a result, as shown in FIGS. 2 to 8, the respective rows of pixels in the display device 1 have pixels with the source signal (+) written thereto, and pixels with the source signal (−) written thereto, arranged alternately. On the other hand, as shown in FIGS. 2 to 8, the respective columns of pixels in the display device 1 only have pixels with the source signal (+) written thereto or pixels with the source signal (−) written thereto.

(Effects)

The display device 1 of Embodiment 1 includes only one source output amplifier for every six source signal lines, the source output amplifier supplying source signals to each of the plurality of source signal lines. Thus, the number of source output amplifiers for supplying the source signal can be greatly reduced, and therefore, it is possible to reduce the cost associated with the source driver. In other words, it is possible to display images more efficiently.

In the display device 1 of Embodiment 1, it is possible to reduce the total steady current needed by the source output amplifiers by reducing the number of source output amplifiers. Thus, the display device 1 of Embodiment 1 can have a reduced power consumption. In other words, it is possible to display images more efficiently.

Embodiment 2

Next, Embodiment 2 of the present invention will be explained. Embodiment 1 only had one source output amplifier for every six source signal lines. In Embodiment 2, an example with two source output amplifiers will be described. In a display device 1 of Embodiment 2, other configurations than the aspects described below are similar to those of the display device 1 of Embodiment 1, and thus, descriptions thereof will be omitted.

(Configuration Example of Source Driver 30)

Figure 9:
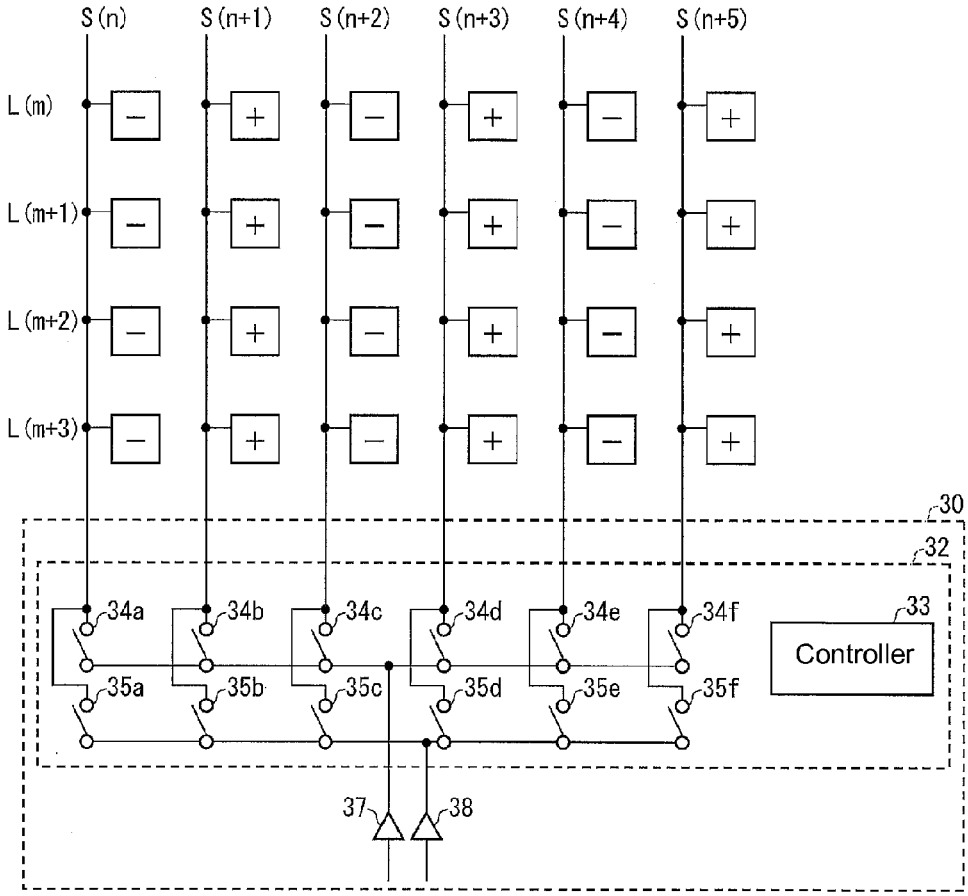
FIG. 9 is a diagram showing an example of a configuration of a source driver of Embodiment 2.

First, a configuration example of the source driver 30 will be described. FIG. 9 shows a configuration example of the source driver 30 according to Embodiment 2. Here too, as in Embodiment 1, the configuration example of the source driver 30 will be described using source signal lines S(n) to S(n+5) among a plurality of source signal lines included in a display panel 2, and rows of pixels L(m) to L(m+3) among a plurality of rows of pixels.

As shown in FIG. 9, the source driver 30 of Embodiment 2 includes source output amplifiers that are fewer in number than the number of source signal lines S. Specifically, the source driver 30 of Embodiment 2 has two source output amplifiers 37 and 38.

The source output amplifier 37 (first source output amplifier) is for supplying a source signal (−) with a negative source signal potential. On the other hand, the source output amplifier 38 (second source output amplifier) is for supplying a source signal (+) with a positive source signal potential.

In other words, while the source output amplifier 36 of Embodiment 1 supplied both the source signal (+) and the source signal (−), the source output amplifiers 37 and 38 of Embodiment 2 respectively supply either the source signal (+) or the source signal (−).

The source driver 30 of Embodiment 2 supplies a source signal to each of the plurality of source signal lines S from the source output amplifier 37 when supplying the source signal (−) and from the source output amplifier 38 when supplying the source signal (+).

In order to achieve this, the output side of the source output amplifiers 37 and 38 has a switching unit 32 for switching the source signal line S to which the source signal outputted from the source output amplifiers 37 and 38 is supplied.

For example, in the example shown in FIG. 9, the switching unit 32 includes a plurality of switches 34*a* to 34*f* for each of the source signal lines S. In addition, the switching unit 32 includes a plurality of switches 35*a* to 35*f* for each of the source signal lines S.

One end of each of the switches 34 is connected to the corresponding source signal line S, whereas the other end of each of the switches 34 is connected to the output end of the source output amplifier 37. In other words, the switches 34*a* to 34*f* are for switching the source signal line S to which the source signal outputted from the source output amplifier 37 is supplied.

On the other hand, one end of each of the switches 35 is connected to the corresponding source signal line S, whereas the other end of each of the switches 35 is connected to the output end of the source output amplifier 38. In other words, the switches 35*a* to 35*f* are for switching the source signal line S to which the source signal outputted from the source output amplifier 38 is supplied.

The operation of the respective switches 34 and 35 (in other words, whether they are on or off) is controlled by a controller 33 included in the switching unit 32.

(Writing Operation by Source Driver 30)

When a source signal (−) is to be supplied to a certain source signal line S, the controller 33 turns on a switch 34 corresponding to this source signal line S. At this time, other switches 34 and switches 35 remain off. As a result, the source output amplifier 37 and the source signal line S are electrically connected, and the source signal (−) outputted from the source output amplifier 37 is supplied to the corresponding source signal line S.

On the other hand, when a source signal (+) is to be supplied to a certain source signal line S, the controller 33 turns on a switch 35 corresponding to this source signal line S. At this time, other switches 34 and switches 35 remain off. As a result, the source output amplifier 38 and the source signal line S are electrically connected, and the source signal (+) outputted from the source output amplifier 38 is supplied to the corresponding source signal line S.

The controller 33 switches which switch is turned on depending on which source signal line the source signal is to be outputted to, every time a source signal is outputted from the source output amplifiers 37 and 38. Thus, a source signal is supplied to each of the plurality of source signal lines S.

One horizontal period in the display device 1 of Embodiment 2 includes a first writing period, a second writing period, and a third writing period, in this order, for example.

In the source driver 30 of Embodiment 2, by having the source output amplifier 37 supply the source signal (−) in parallel with the source output amplifier 38 supplying the source signal (+) during each writing period, writing can be performed to six source signal lines S (source signal lines S(n) to S(n+5)) during three writing periods (first to third writing periods).

The controller 33 turns on corresponding switches 34 and 35 every time the writing period changes, and turns off all other switches 34 and 35. As a result, during each writing period, a corresponding first source signal line S is connected to the source output amplifier 37, and a source signal (−) outputted from the source signal amplifier 37 is supplied to this source signal line S. At the same time, a corresponding second source signal line S is connected to the source output amplifier 38, and a source signal (+) outputted from the source signal amplifier 38 is supplied to this source signal line S.

Figure 10:
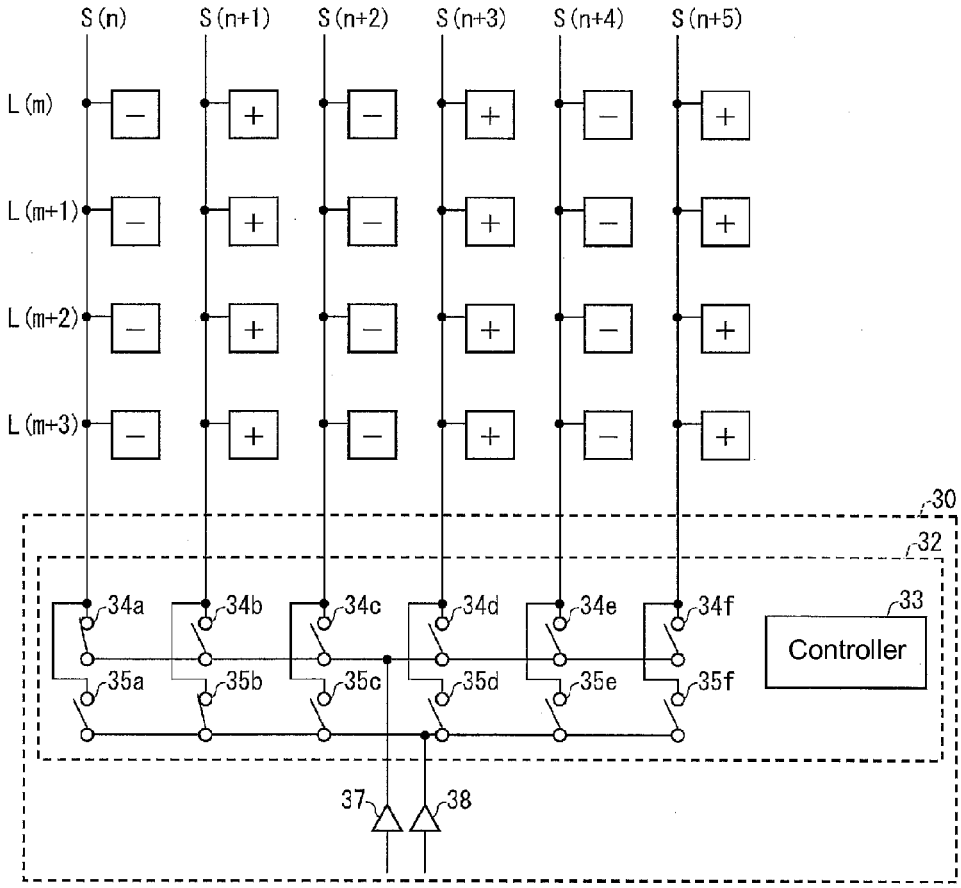
FIG. 10 shows a first writing period state of the source driver of Embodiment 2.
Figure 11:
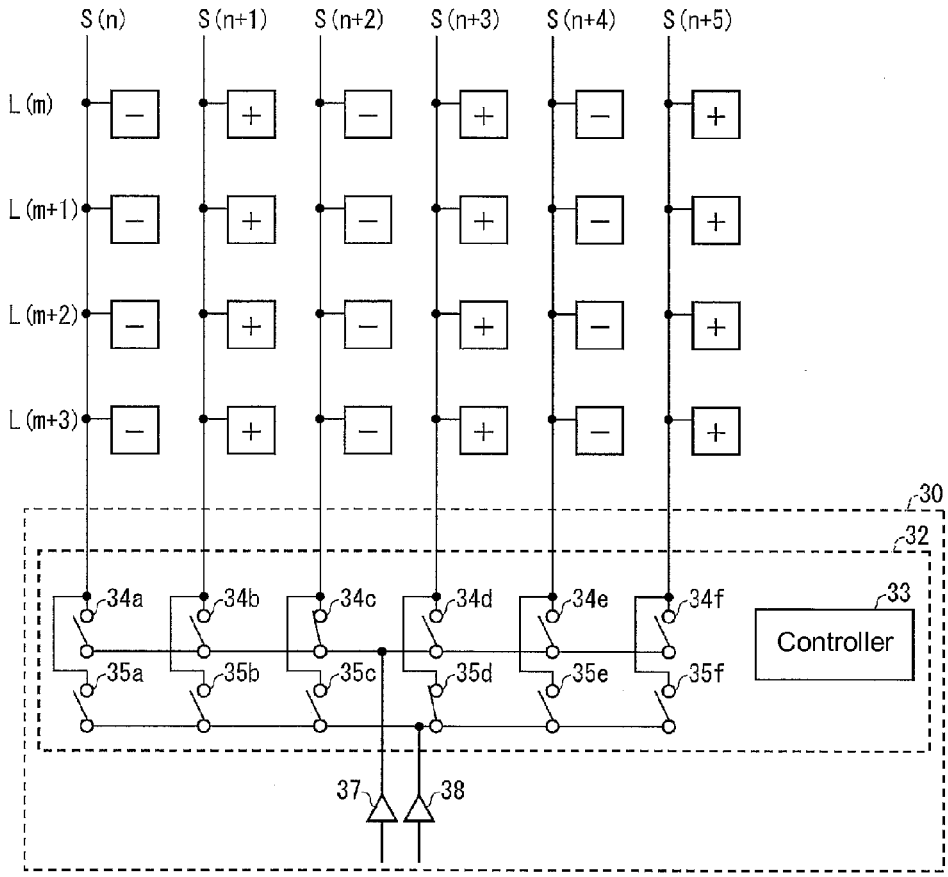
FIG. 11 shows a second writing period state of the source driver of Embodiment 2.
Figure 12:
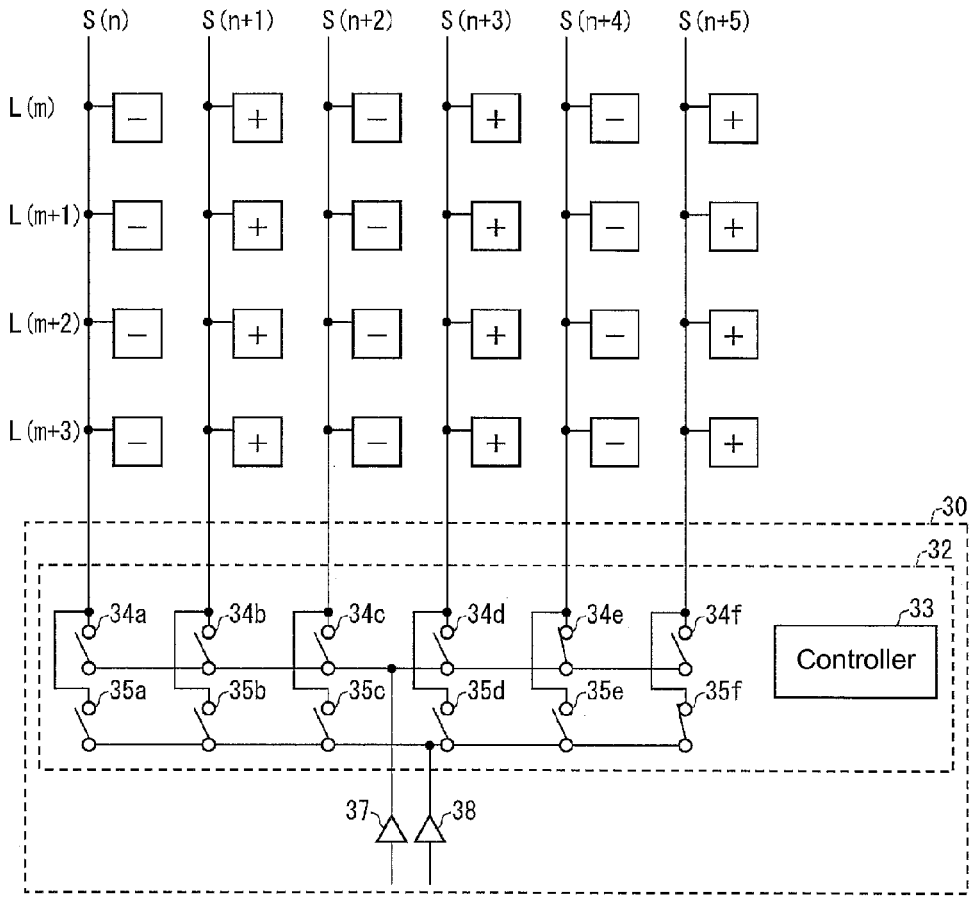
FIG. 12 shows a third writing period state of the source driver of Embodiment 2.

With reference to FIGS. 10 to 12, a specific example of a writing operation of the source signal by the source driver 30 of Embodiment 2 will be described below.

(First Writing Period)

FIG. 10 shows a first writing period state of the source driver 30 of Embodiment 2. During the first writing period, the source driver 30 writes a source signal to the source signal lines S(n) and S(n+1).

Specifically, for the respective rows of pixels, the source driver 30 writes the source signal (−) to the source signal line S(n) and the source signal (+) to the source signal line S(n+1) simultaneously.

Thus, as shown in FIG. 10, the controller 33 turns on the switch 34*a* corresponding to the source signal line S(n) and turns on the switch 35*b* corresponding to the source signal line S(n+1), and turns off all other switches.

As a result, the source output amplifier 37 and the source signal line S(n) are electrically connected to each other, and the source output amplifier 38 and the source signal line S(n+1) are electrically connected to each other. The source signal (−) outputted from the source output amplifier 37 is supplied to the source signal line S(n), and the source signal (+) outputted from the source output amplifier 38 is supplied to the source signal line S(n+1).

(Second Writing Period)

FIG. 11 shows a second writing period state of the source driver 30 of Embodiment 2. During the second writing period, the source driver 30 writes a source signal to the source signal lines S(n+2) and S(n+3).

Specifically, for the respective rows of pixels, the source driver 30 writes the source signal (−) to the source signal line S(n+2) and the source signal (+) to the source signal line S(n+3) simultaneously.

Thus, as shown in FIG. 11, the controller 33 turns on the switch 34*c* corresponding to the source signal line S(n+2) and turns on the switch 35*d* corresponding to the source signal line S(n+3), and turns off all other switches.

As a result, the source output amplifier 37 and the source signal line S(n+2) are electrically connected to each other, and the source output amplifier 38 and the source signal line S(n+3) are electrically connected to each other. The source signal (−) outputted from the source output amplifier 37 is supplied to the source signal line S(n+2), and the source signal (+) outputted from the source output amplifier 38 is supplied to the source signal line S(n+3).

(Third Writing Period)

FIG. 12 shows a third writing period state of the source driver 30 of Embodiment 2. During the third writing period, the source driver 30 writes a source signal to the source signal lines S(n+4) and S(n+5).

Specifically, for the respective rows of pixels, the source driver 30 writes the source signal (−) to the source signal line S(n+4) and the source signal (+) to the source signal line S(n+5) simultaneously.

Thus, as shown in FIG. 12, the controller 33 turns on the switch 34*e* corresponding to the source signal line S(n+4) and turns on the switch 35*f* corresponding to the source signal line S(n+5), and turns off all other switches.

As a result, the source output amplifier 37 and the source signal line S(n+4) are electrically connected to each other, and the source output amplifier 38 and the source signal line S(n+5) are electrically connected to each other. The source signal (−) outputted from the source output amplifier 37 is supplied to the source signal line S(n+4), and the source signal (+) outputted from the source output amplifier 38 is supplied to the source signal line S(n+5).

FIGS. 10 to 12 show a state of the respective switches during a certain frame period, but when the frame period is switched, where the switch 34 is turned on in the description above, the corresponding switch 35 is turned on by the controller 33, and where the switch 35 is turned on in the description above, the corresponding switch 34 is turned on by the controller 33 such that the source signal supplied to the respective source signal lines S undergoes a polarity inversion.

As a result, as shown in FIGS. 10 to 12, the respective rows of pixels in the display device 1 have pixels with the source signal (+) written thereto, and pixels with the source signal (−) written thereto, arranged alternately. On the other hand, as shown in FIGS. 10 to 12, the respective columns of pixels in the display device 1 only have pixels with the source signal (+) written thereto or pixels with the source signal (−) written thereto.

(Effects)

The display device 1 of Embodiment 2 includes only two source output amplifiers for every six source signal lines, the source output amplifiers supplying source signals to each of the plurality of source signal lines. Thus, the number of source output amplifiers for supplying the source signal can be greatly reduced, and therefore, it is possible to reduce the cost associated with the source driver. In other words, it is possible to display images more efficiently.

In the display device 1 of Embodiment 2, it is possible to reduce the total steady current needed by the source output amplifiers by reducing the number of source output amplifiers. Thus, the display device 1 of Embodiment 2 can have a reduced power consumption. In other words, it is possible to display images more efficiently.

The display device 1 of Embodiment 2 used the source output amplifiers 37 and 38 that supply either the source signal (+) or the source signal (−). Thus, compared to a configuration in which the source output amplifier supplies both the source signal (+) and the source signal (−), the range of voltage durability of the source output amplifiers can be narrowed by restricting each to either positive or negative, and thus, it is possible to reduce power consumption by the source output amplifiers. Thus, the display device 1 of Embodiment 2 can have a further reduced power consumption. In other words, it is possible to display images more efficiently.

In the display device 1 of Embodiment 2, the source signal (+) and the source signal (−) were written in parallel. Thus, it is possible to shorten the writing period for the source signal. For example, while six writing periods were required in Embodiment 1 to supply source signals to six source signal lines S, in Embodiment 2, only three writing periods are required to supply source signals to six source signal lines S. By being able to shorten the writing period for the source signals, it is possible to shorten the horizontal scanning period. Thus, in the display device 1 of Embodiment 2, it is possible to display more images within a prescribed unit time, and as a result, it is possible to improve display quality. In other words, it is possible to display images more efficiently.

Embodiment 3

Next, Embodiment 3 of the present invention will be explained. In Embodiment 3, an example in which the connection between the source signal lines and the columns of pixels is different will be described. In a display device 1 of Embodiment 3, other configurations than the aspects described below are similar to those of the display device 1 of Embodiment 1, and thus, descriptions thereof will be omitted.

(Configuration of Display Panel 2)

Figure 13:
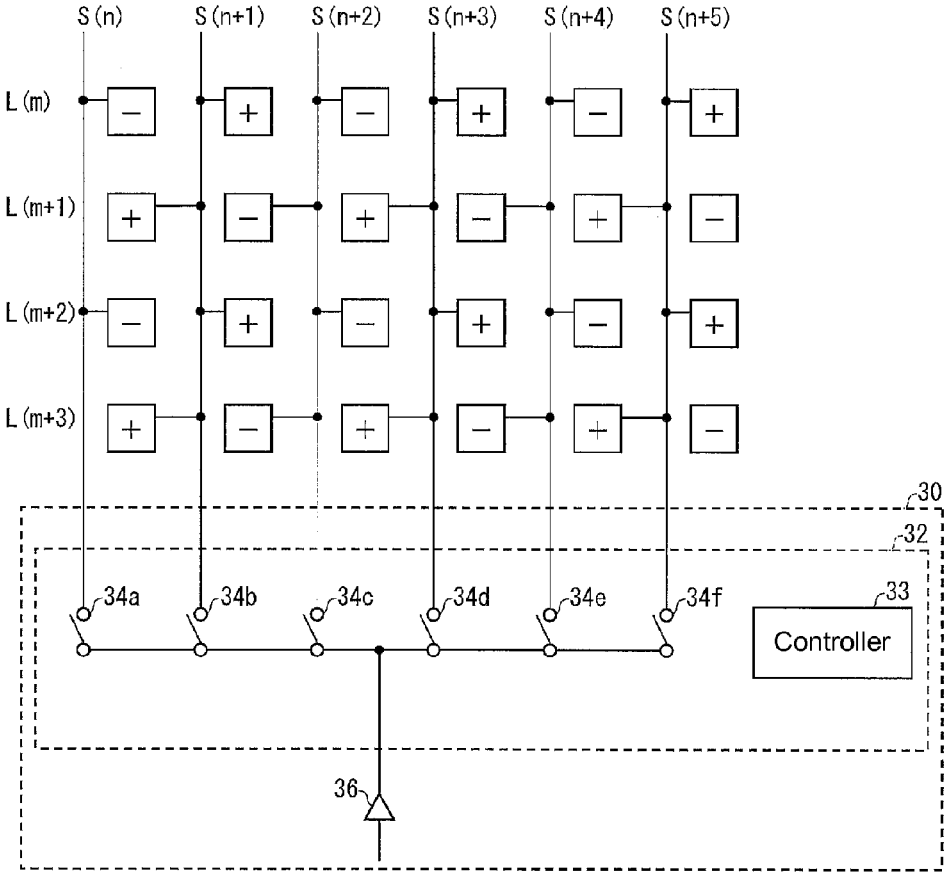
FIG. 13 is a diagram showing an example of a configuration of a display panel 2 of Embodiment 3.

FIG. 13 shows a configuration example of a display panel 2 according to Embodiment 3. As shown in FIG. 2, the display device 1 of Embodiment 1 was configured such that one column of pixels is connected to one source signal line and driven thereby. By contrast, as shown in FIG. 13, the display device 1 of Embodiment 3 is configured such that one column of pixels is connected alternately to two source signal lines that have this column of pixels therebetween, and is driven thereby. In other words, each source signal line is configured so as to alternately drive two columns of pixels that have this source signal line therebetween.

(Writing Operation)

The source driver 30 of Embodiment 3 supplies a source signal to each source signal line S, inverting the polarity of the voltage supplied as the source signal for every source signal line S. However, when focusing on one frame period, each source signal line is only supplied a source signal (+) or a source signal (−). In other words, the source driver 30 performs so-called source inversion driving.

In the example shown in FIG. 13, for example, in this frame period, the source driver 30 supplies only a source signal (−) to source signal lines S(n), S(n+2), and S(n+4). On the other hand, only a source signal (+) is supplied to source signal lines S(n+1), S(n+3), and S(n+5).

(Effects)

As described above, the source driver 30 of Embodiment 3 conducts so-called source inversion driving, but because one source signal line S drives two pixel columns alternately, as shown in FIG. 13, on the display panel 2, each pixel column and each pixel row include pixels to which the source signal (+) is written and pixels to which the source signal (−) is written, arranged alternately. In other words, despite the fact that source inversion driving is performed, an effect similar to that of dot inversion driving can be attained.

MODIFICATION EXAMPLES

The present invention is not limited to the above-mentioned embodiments, and various modifications can be made without departing from the scope of the claims. That is, embodiments obtained by combining techniques modified without departing from the scope of the claims are also included in the technical scope of the present invention.

Modification Example 1

The configuration of the switching unit 32 shown in the respective embodiments is only one example. When implementing the present invention, any configuration may be used for the switching unit as long as the effects thereof are similar to those of the switching unit 32.

Modification Example 2

In Embodiment 2, the source signal is written in parallel to a plurality of source signal lines S by the source output amplifiers 37 and 38, but a configuration in which the source signals are written sequentially may be used.

Modification Example 3

The present invention is not limited to being applied to a display device with source inversion driving. In the present embodiment, an example was described in which the present invention is applied to a display device with so-called source inversion driving, in which each column of pixels only has pixels to which a source signal with a positive source signal potential is to be written, or pixels to which a source signal with a negative source signal potential is to be written.

The present invention is not limited thereto and may be applied to display devices with so-called dot inversion driving or the like in which all columns of pixels have pixels to which a source signal with a positive source signal potential is to be written and pixels to which a source signal with a negative source signal potential is to be written, arranged alternately.

Modification Example 4

In the embodiments, examples having one or two source output amplifiers were described, but as long as the number of source output amplifiers provided is less than the number of source signal lines, three or more source output amplifiers may be provided.

(Configuration of Pixels)

Figure 14:
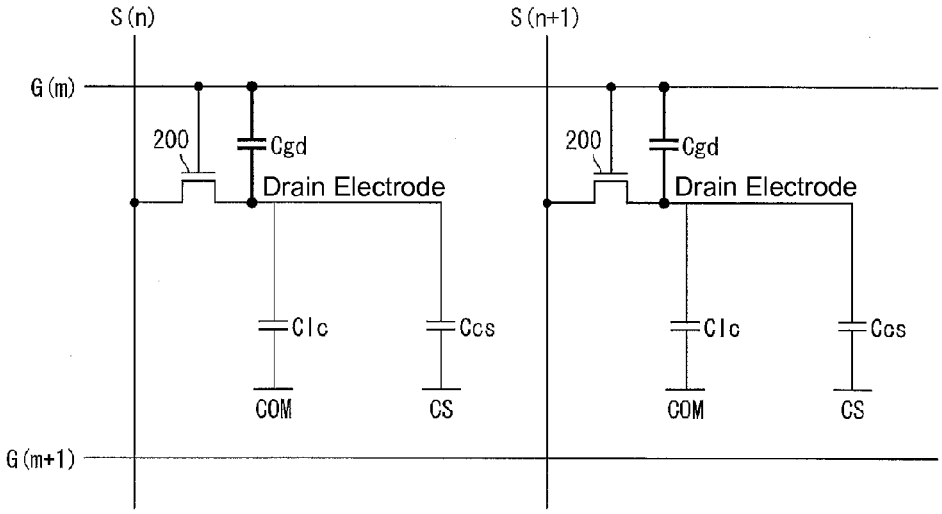
FIG. 14 is a diagram showing a configuration of pixels included in the display panel 2.

A configuration of pixels included in the display panel 2 will be described below. FIG. 14 is a diagram showing a configuration of pixels included in the display panel 2. FIG. 14 shows a configuration of two pixels (pixel (n, m) and pixel (n+1, m)) among the plurality of pixels included in the display panel 2. The pixel (n, m) refers to a pixel connected to the source signal line S(n) and the gate signal line G(m). The pixel (n+1, m) refers to a pixel connected to the source signal line S(n+1) and the gate signal line G(m). Other pixels included in the display panel 2 have a configuration similar to the above-mentioned pixels.

As shown in FIG. 14, the pixels each include a TFT 200 as a switching element. The gate electrode of the TFT 200 is connected to a corresponding gate signal line G. The source electrode of the TFT 200 is connected to a corresponding source signal line S. The drain electrode of the TFT 200 is connected to a liquid crystal capacitance Clc and a storage capacitance Ccs.

When pixel data is to be written to this pixel, first, an on voltage is supplied through the gate signal line G to the gate electrode of the TFT 200. As a result, the TFT 200 is switched on.

When the TFT 200 is on, a source signal is supplied through a corresponding source signal line S, and this source signal is supplied from the drain electrode of the TFT 200 to the pixel electrode of the liquid crystal capacitance Clc and the storage capacitance Ccs.

By having the source signal be supplied to the pixel electrode of the liquid crystal capacitance Clc in this manner, at the pixel, an orientation direction of liquid crystal sealed between the pixel electrode and a common electrode of the liquid crystal capacitance Clc is changed in accordance with a difference between the voltage level of the supplied source signal and the voltage level of a voltage supplied to the common electrode, and an image based on this difference is displayed.

Also, by having a source signal be supplied to the storage capacitance Ccs, a charge based on the voltage of the source signal is stored in the storage capacitance Ccs. Based on the charge stored in the storage capacitance Ccs, the pixel can maintain a state in which the image is displayed for a certain period of time.

In the pixels included in the display panel 2, a TFT using a so-called oxide semiconductor is used as the TFT 200, and in particular, so-called IGZO (InGaZnOx), which is an oxide constituted of indium (In), gallium (Ga), and zinc (Zn), is used as the oxide semiconductor.

(TFT Characteristics)

Figure 15:
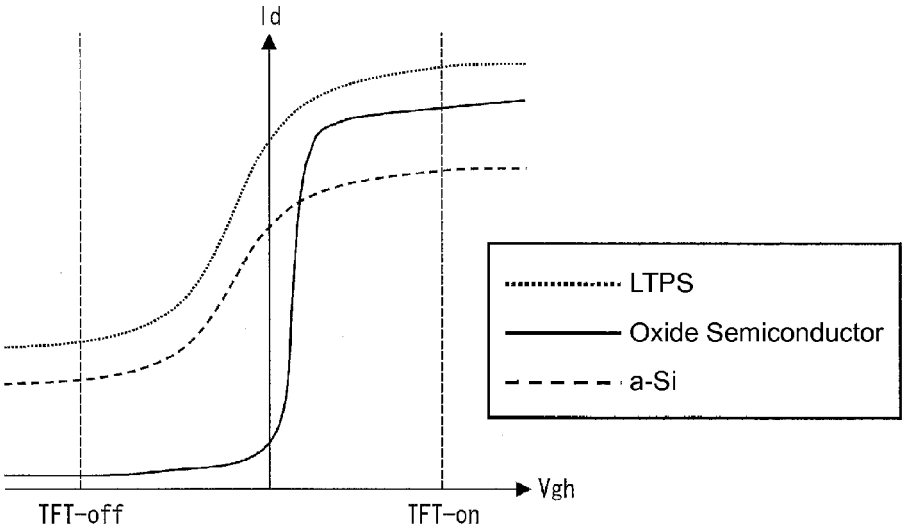
FIG. 15 is a diagram showing characteristics of various types of TFTs.

FIG. 15 shows characteristics of various types of TFTs. FIG. 15 shows characteristics of a TFT using an oxide semiconductor, a TFT using a-Si (amorphous silicon), and a TFT using LTPS (low temperature polysilicon).

In FIG. 15, the horizontal axis (Vgh) shows a value of an on voltage supplied to the gate of each TFT, and the vertical axis (Id) shows the amount of current flowing between the source and the drain of each TFT.

In particular, the period shown in the drawing as "TFT-on" indicates a period during which the TFT is on based on the value of the on voltage, and the period shown in the drawings as "TFT-off" indicates a period during which the TFT is off based on the value of the on voltage.

As shown in FIG. 15, the TFT using the oxide semiconductor has a higher electron mobility in the on state than the TFT using a-Si.

Although omitted from the drawings, specifically, the TFT using a-Si has an Id current during the TFT-on time of 1 μA, whereas the TFT using the oxide semiconductor has an Id current during the TFT-on time of 20-50 μA.

Thus, the TFT using the oxide semiconductor has an electron mobility during the on state of approximately 20 to 50 times that of the TFT using a-Si, and thus, has excellent on characteristics.

As already described, the display device 1 of the embodiments of the present invention uses TFTs having such an oxide semiconductor in the respective pixels.

Thus, because the display device 1 of the embodiments of the present invention has excellent on characteristics, it is possible to drive pixels with smaller TFTs, and thus, it is possible to reduce the proportion of area taken up by the TFT in each pixel. That is, the aperture ratio in each pixel can be improved, and the transmittance of backlight can be increased. As a result, because this allows a backlight with low power consumption to be used, or allows the brightness of a backlight to be reduced, a reduction in power consumption can be achieved.

Also, because the on characteristics of the TFT are excellent, it is possible to reduce the writing time for the source signal to each pixel, and thus, it is possible to increase the refresh rate of the display panel 2 with ease.

As shown in FIG. 15, the leak current of the TFT using the oxide semiconductor during the off state is less than that of the TFT using the a-Si.

Although omitted from the drawings, specifically, the TFT using the a-Si has an Id current of 10 pA during the TFT-off time, whereas the TFT using the oxide semiconductor has an Id current of approximately 0.1 pA during the TFT-off time.

Thus, the leak current of the TFT using the oxide semiconductor during the off state is approximately one-hundredth of that of the TFT using the a-Si, and thus, the TFT using the oxide semiconductor has excellent off characteristics in which almost no leak current is generated.

Thus, the display device 1 of the embodiments of the present invention has TFTs with excellent off characteristics, and thus, a state in which the source signal is written to each of the plurality of pixels in the display panel can be maintained for a long period of time, which allows the refresh rate of the display panel 2 to be decreased with ease.

(Summary)

As described above, the display device of the present invention includes: a display panel having a plurality of gate signal lines and a plurality of source signal lines; a gate driver that sequentially selects the plurality of gate signal lines and performs scanning thereon; and a source driver that supplies data signals through the plurality of source signal lines to a plurality of pixels, respectively connected to a selected gate signal line, in which the source driver includes: source output amplifiers that are fewer in number than the plurality of source signal lines; and a switching unit that switches a destination of a data signal to a source signal line among the plurality of source signal lines, every time the source output amplifiers output the data signal, in which, with respect to each of the source output amplifiers, by using the switching unit in order to switch a destination of a first type data signal having a positive potential and a second type data signal having a negative potential, which are sequentially outputted from the source output amplifiers, the first type data signal and the second type data signal are supplied in an alternating fashion to the respective plurality of pixels connected to each of the plurality of gate signal lines, and only one of either the first type data signal or the second type data signal is supplied to the plurality of pixels connected to each of the plurality of source signal lines, and in which, every time a frame period is switched, a data signal supplied to the plurality of pixels is switched between the first type data signal and the second type data signal for each of the plurality of source signal lines.

According to this configuration, it is possible to reduce the number of source output amplifiers compared to a configuration of a conventional display device in which a source output amplifier is provided for each source signal line, and thus, the cost associated with the source driver can be reduced. Also, by reducing the number of source output amplifiers, it is possible to reduce the total steady current needed by the source output amplifiers. Thus, it is possible to reduce power consumption. In other words, it is possible to display images more efficiently.

In the above-mentioned display device, it is preferable that the source driver have one source output amplifier, and that the switching unit switch a destination of supply of the data signal to a source signal line to which the data signal is to be supplied among the plurality of source signal lines every time the one source output amplifier outputs the data signal.

With this configuration, the number of source output amplifiers can be greatly reduced, thus reducing the cost associated with the source driver. Also, it is possible to further reduce the total steady current needed by the source output amplifier. Thus, it is possible to further reduce power consumption. In other words, it is possible to display images more efficiently.

In the above-mentioned display device, it is preferable that the one source output amplifier output the first data signal having a positive data signal potential and the second data signal having a negative data signal potential, in an alternating fashion, and that the switching unit switch a destination of supply of the first data signal to a source signal line to which the first data signal is to be supplied among the plurality of source signal lines every time the one source output amplifier outputs the first data signal, and switch a destination of supply of the second data signal to a source signal line to which the second data signal is to be supplied among the plurality of source signal lines every time the one source output amplifier outputs the second data signal.

According to this configuration, it is possible to apply a configuration similar to that of the above-mentioned display device even if a display drive method in which the data signal potential differs depending on the source signal line, as in dot inversion driving or the like, is used, and thus, effects similar to those of the above-mentioned display device can be attained.

In the above-mentioned display device, it is preferable that the source driver include: a first source output amplifier that outputs a first type data signal having a positive potential; and a second source output amplifier that outputs a second type data signal having a negative potential, and that the switching unit switch a destination of the first type data signal to a source signal line among the plurality of source signal lines every time the first source output amplifier outputs the first type data signal, and switch a destination of the second type data signal to a source signal line among the plurality of source signal lines every time the second source output amplifier outputs the second type data signal.

With this configuration, the number of source output amplifiers can be greatly reduced, thus reducing the cost associated with the source driver. Also, it is possible to further reduce the total steady current needed by the source output amplifiers. Thus, it is possible to further reduce power consumption. In other words, it is possible to display images more efficiently.

Also, compared to a configuration in which the source output amplifier supplies both the first data signal having a positive data signal potential and the second data signal having a negative data signal potential, the range of voltage durability of the source output amplifiers can be narrowed by restricting each to either positive or negative, and thus, it is possible to reduce power consumption by the source output amplifiers. Thus, it is possible to further reduce power consumption. In other words, it is possible to display images more efficiently.

In the above-mentioned display device, it is preferable that output of the first type data signal by the first source output amplifier and output of the second type data signal by the second source output amplifier be performed in parallel, and that supply of the first type data signal to a source signal line and supply of the second type data signal line to a source signal line be performed in parallel.

According to this configuration, it is possible to shorten the writing period for the source signals. In other words, it is possible to shorten the horizontal scanning period, and thus, more images can be displayed within a prescribed unit time period, thereby increasing the display quality. In other words, it is possible to display images more efficiently.

Also, in the above-mentioned display device, it is preferable that an oxide semiconductor be used in the semiconductor layer of the TFT (switching element) of each of the plurality of pixels included in the display panel. In particular, in the above-mentioned display device, it is preferable that the oxide semiconductor be IGZO (InGaZnOx).

According to this configuration, by using a TFT having an oxide semiconductor with excellent on characteristics and off characteristics in each of the pixels (in particular, IGZO, which has excellent on characteristics and off characteristics) in a display device, it is possible to drive the display panel with less power consumed. In other words, it is possible to display images more efficiently.

INDUSTRIAL APPLICABILITY

The display device according to the present invention can be used in various active matrix display devices such as liquid crystal display devices, organic EL display devices, and electronic paper.

DESCRIPTION OF REFERENCE CHARACTERS

1 display device
2 display panel
4 gate driver
8 common electrode driver circuit
10 timing controller
13 power generating circuit
30 source driver
32 switching unit
33 controller
34 switch
35 switch
36 source output amplifier
37 source output amplifier
38 source output amplifier

The invention claimed is:

1. A display device, comprising:

a display panel having a plurality of gate signal lines and a plurality of source signal lines;

a gate driver that sequentially selects the plurality of gate signal lines and performs scanning thereon; and a source driver that supplies data signals through the plurality of source signal lines to a plurality of pixels, respectively connected to a selected gate signal line, wherein the source driver comprises:

source output amplifiers that are fewer in number than the plurality of source signal lines; and a switching unit that switches a destination of a data signal to a source signal line among the plurality of source signal lines, every time the source output amplifiers output the data signal, wherein, with respect to each of the source output amplifiers, by using the switching unit in order to switch a destination of a first type data signal having a positive potential and a second type data signal having a negative potential, which are sequentially outputted from the source output amplifiers, the first type data signal and the second type data signal are supplied in an alternating fashion to the respective plurality of pixels connected to each of the plurality of gate signal lines, and only one of either the first type data signal or the second type data signal is supplied to the plurality of pixels connected to each of the plurality of source signal lines, wherein, every time a frame period is switched, a data signal supplied to the plurality of pixels is switched between the first type data signal and the second type data signal for each of the plurality of source signal lines, wherein the source driver comprises:

a first source output amplifier that outputs a first type data signal having a positive potential; and a second source output amplifier that outputs a second type data signal having a negative potential, and wherein the switching unit switches a destination of the first type data signal to a source signal line among the plurality of source signal lines every time the first source output amplifier outputs the first type data signal, and switches a destination of the second type data signal to another source signal line, which is different from said source signal line that is the destination of the first type data signal, among the plurality of source signal lines every time the second source output amplifier outputs the second type data signal.

2. The display device according to claim 1, wherein output of the first type data signal by the first source output amplifier and output of the second type data signal by the second source output amplifier are performed in parallel, and wherein supply of the first type data signal to said source signal line as the destination of the first type data signal and supply of the second type data signal line to said another source signal line as the destination of the second type data signal are performed in parallel.

3. The display device according to claim 1, wherein an oxide semiconductor is used in a semiconductor layer of a switching element of each of the plurality of pixels included in the display panel.

4. The display device according to claim 3, wherein the oxide semiconductor is IGZO.

* * * * *